US007555983B2

(12) United States Patent
Iyokawa et al.

(10) Patent No.: US 7,555,983 B2
(45) Date of Patent: Jul. 7, 2009

(54) PLATE HANDLING APPARATUS

(75) Inventors: Kazuya Iyokawa, Chiba (JP); Kazunori Takeda, Chiba (JP)

(73) Assignee: Komori Corporation, Tokyo (JP)

( * ) Notice: Subject to any disclaimer, the term of this patent is extended or adjusted under 35 U.S.C. 154(b) by 223 days.

(21) Appl. No.: 11/444,556

(22) Filed: May 31, 2006

(65) Prior Publication Data

US 2006/0272531 A1 Dec. 7, 2006

(30) Foreign Application Priority Data

Jun. 3, 2005 (JP) ..... 2005-163755

(51) Int. Cl.
*B41F 27/12* (2006.01)

(52) U.S. Cl. ..... 101/477; 101/415.1

(58) Field of Classification Search ..... 101/477, 101/415.1, 484, 480
See application file for complete search history.

(56) References Cited

U.S. PATENT DOCUMENTS 5,255,420 A * 10/1993 Maejima et al. ..... 29/240
5,487,336 A * 1/1996 Simeth ..... 101/216
6,393,986 B1 5/2002 Tobe et al.
6,499,400 B2 * 12/2002 Onuma et al. ..... 101/477
6,802,257 B2 10/2004 Tobe et al.
6,854,392 B2 * 2/2005 Tobe ..... 101/477
6,973,876 B2 * 12/2005 Nakano et al. ..... 101/477
2004/0168600 A1 * 9/2004 Tobe et al. ..... 101/477

* cited by examiner

*Primary Examiner*—Ren Yan
(74) *Attorney, Agent, or Firm*—Blakely, Sokoloff, Taylor & Zafman LLP

(57) ABSTRACT

A plate handling apparatus includes a loader, first and second air cylinders, and first and second detection units. The loader is supported to be movable substantially parallel to a paper convey direction and swingable in directions to come close to and be spaced apart from an outer surface of a plate cylinder to perform plate removal/supply. The first air cylinder moves the loader among a first position close to the plate cylinder, a second position spaced apart from the first position in the paper convey direction, and a third position which is between the first position and the second position. The second air cylinder swings the loader among a first swing state where the loader is substantially perpendicular to the paper convey direction, a second swing state where the loader is inclined such that its distal end faces the plate cylinder, and a third swing state which is between the first swing state and the second swing state. The first detection unit detects a position of the loader in the paper convey direction. The second detection unit detects a swing state of the loader.

22 Claims, 14 Drawing Sheets

PLATE HANDLING APPARATUS

BACKGROUND OF THE INVENTION

The present invention relates to a plate handling apparatus comprising a new plate inserting device which supplies a new plate to the plate cylinder of a printing press, an old plate removing device which removes an old plate from the plate cylinder, and a plate exchange device which removes the old plate from the plate cylinder and supplies the new plate to the plate cylinder.

As shown in U.S. Pat. No. 6,393,986, a conventional plate handling apparatus comprises a plate holding device which stores an old plate removed from a plate cylinder and holds a new plate to be supplied to the plate cylinder, the first guide device which guides the old plate removed from the plate cylinder to the plate holding device, and the second guide device which positions a new plate supplied from the plate holding device and guides it to the plate cylinder. In this arrangement, when the plate holding device is swung during plate removal, the old plate removed from the plate cylinder is guided to the plate holding device through the first guide device and stored in the plate holding device. Similarly, when the plate holding device is swung during plate supply, the new plate is moved to a plate supply position where the new plate can be supplied to the plate cylinder, and is supplied to the plate cylinder through the second guide device.

In the conventional plate handling apparatus described above, the second guide device which positions the new plate before inserting it in the plate cylinder is provided separately of the plate holding device. Also, the second guide device is arranged between the plate holding device and plate cylinder. When the plate size increases, although length of the outer surface of the plate cylinder increases, the diameter of the plate cylinder does not increase compared to the length of the outer surface, and the outer shape of an inking device or the like does not become bulky. Hence, the outer shape of a printing unit itself does not become bulky so much. Meanwhile, gaps among printing units lead to a restriction on the installation space in the factory and destabilization of the tension with respect to the web. Accordingly, there is a restriction to an increase in gaps among the printing units.

Therefore, in the conventional plate handling apparatus, if the plate size increases, the plate holding device or second guide device may come into contact with other members. When the plate size increases, the entire length of the plate holding device itself increases, and the lower end (rear end) of the plate holding device comes into contact with the floor. Hence, to increase the plate size is not easy. In particular, in the case of a perfecter, in a lower plate exchange device, the space between the floor and the web to be conveyed is restricted to a certain degree. Because the plate exchange device must be stored in the restricted space, an increase in plate size cannot be coped with.

SUMMARY OF THE INVENTION

It is an object of the present invention to provide a plate handling apparatus that can cope with an increase in plate size.

In order to achieve the above object, according to the present invention, there is provided a plate handling apparatus comprising a loader which is supported to be movable substantially parallel to a paper convey direction and swingable in directions to come close to and be spaced apart from an outer surface of a plate cylinder to perform plate removal/supply, first driving means for moving the loader among a first position close to the plate cylinder, a second position spaced apart from the first position in the paper convey direction, and a third position which is between the first position and the second position, second driving means for swinging the loader among a first swing state where the loader is substantially perpendicular to the paper convey direction, a second swing state where the loader is inclined such that a distal end thereof faces the plate cylinder, and a third swing state which is between the first swing state and the second swing state, first detection means for detecting a position of the loader in the paper convey direction, and second detection means for detecting a swing state of the loader.

DESCRIPTION OF THE PREFERRED EMBODIMENT

Figure 13:
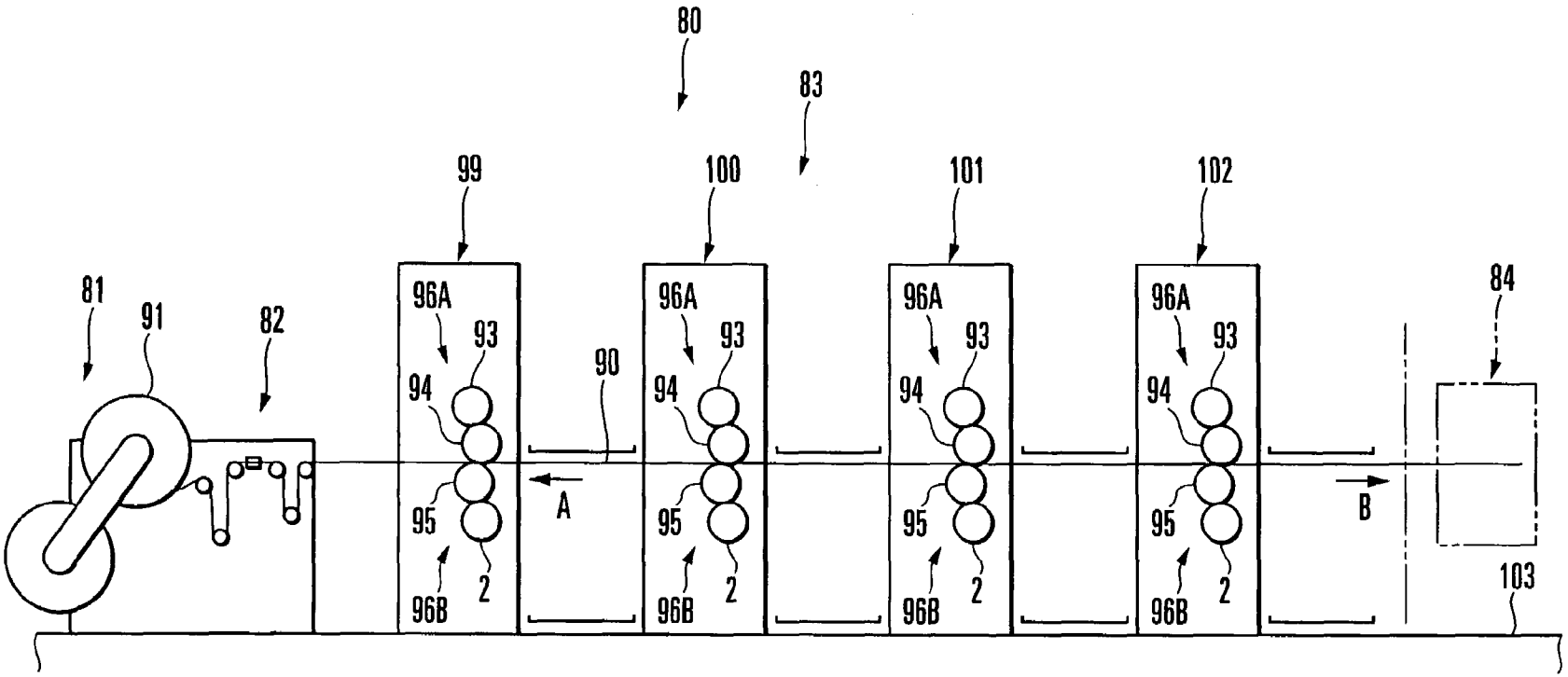
FIG. 13 is a view showing the schematic arrangement of a rotary printing press to which the plate handling apparatus according to the present invention is applied.

A plate handling apparatus according to an embodiment of the present invention will be described with reference to FIGS. 1 to 9C and FIG. 13. As shown in FIG. 13, a feeder 81, infeed unit 82, printing unit 83, and folder 84 are sequentially arranged in a rotary printing press 80 in the convey direction of a web 90 (to be referred to a paper convey direction hereinafter). The feeder 81 is provided with a take-up roll 91. The printing unit 83 prints on the web 90 which is fed from the infeed unit 82 and conveyed substantially horizontally. After the web 90 printed by the printing unit 83 is dried by a drier and cooled by a cooler, the folder 84 folds the web 90 with a predetermined format.

The printing unit 83 comprises four printing units 99, 100, 101, and 102 arrayed in the paper convey direction. Each of the printing units 99, 100, 101, and 102 includes an upper printing unit 96A which prints on the obverse surface of the web 90 and a lower printing unit 96B which prints in the reverse surface of the web 90. The upper printing unit 96A has an upper plate cylinder 93 and an upper blanket cylinder 94 which is in contact with the upper plate cylinder 93. The lower printing unit 96B has a lower plate cylinder 2 and a lower blanket cylinder 95 which is in contact with the lower plate cylinder 2. The upper and lower blanket cylinders 94 and 95 are in contact with each other, between which the web 90 passes.

More specifically, when ink and dampening water from an inking device (not shown) and dampening device (not shown) are supplied to the plate cylinder 93 and plate cylinder 2, respectively, ink corresponding to the image of a plate mounted on the plate cylinder 93 and ink corresponding to the image of a plate mounted on the plate cylinder 2 are respectively transferred to the blanket cylinders 94 and 95. While the web 90 passes between the blanket cylinders 94 and 95, the images are printed on the two surfaces of the web 90.

Figure 1:
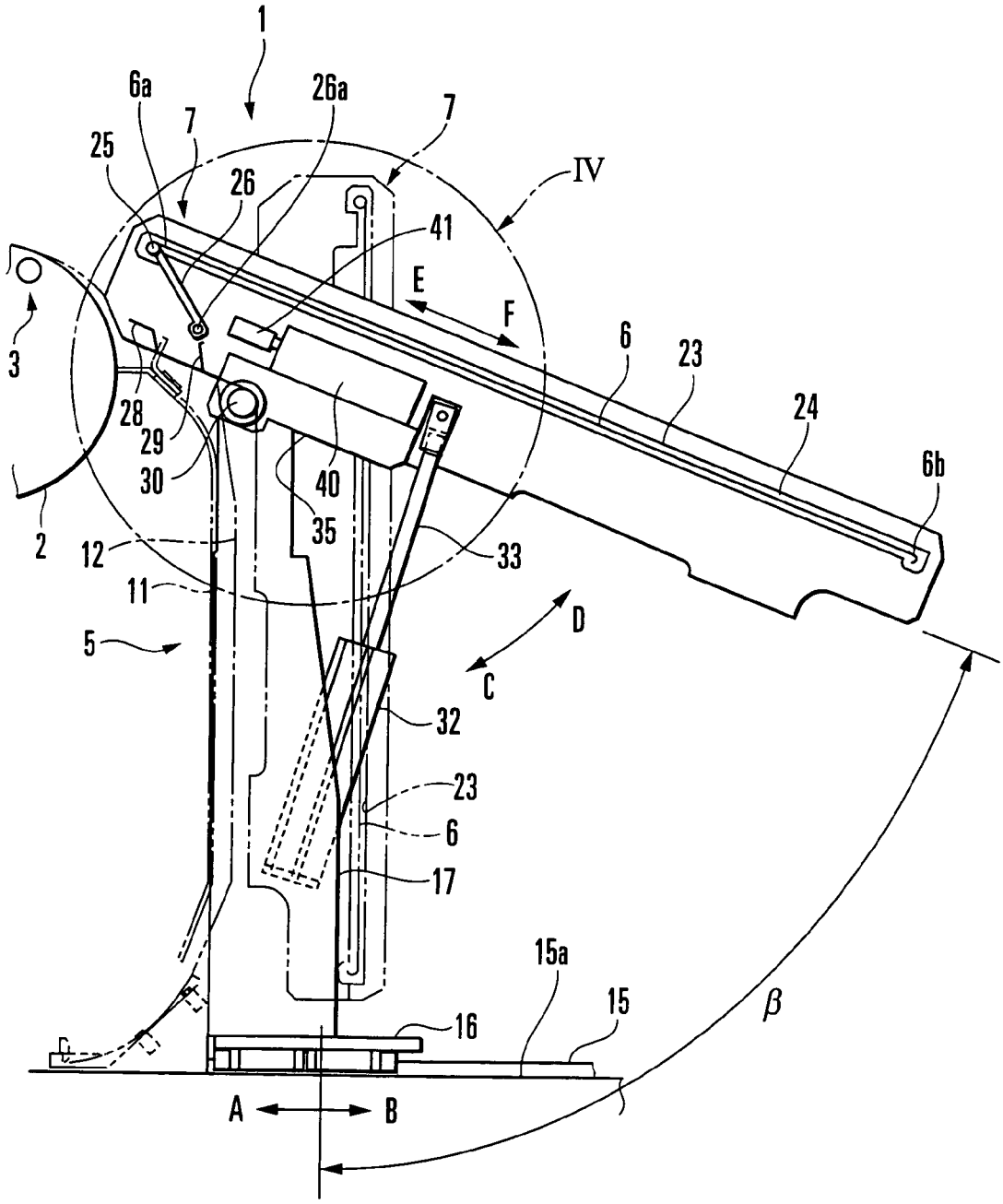
FIG. 1 is a side view showing the schematic arrangement of a plate handling apparatus according to an embodiment of the present invention.
Figure 2:
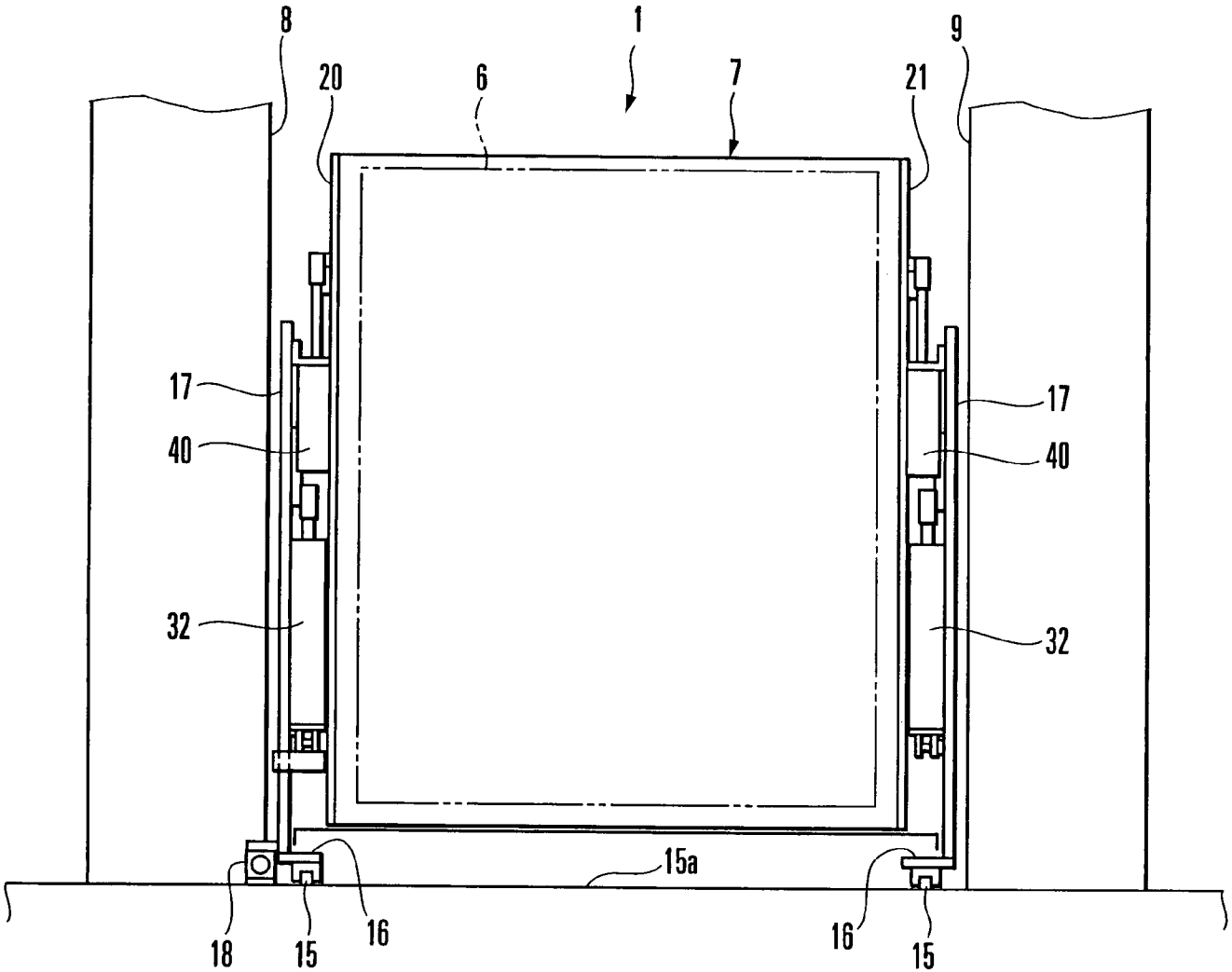
FIG. 2 is a front view of the plate handling apparatus shown in FIG. 1.

The upper and lower printing units 96A and 96B comprise plate handling apparatuses to be described later. The plate handling apparatuses comprise loaders 7 and 97 which supply the new plates to the plate cylinders 2 and 93, respectively. A plate handling device 1 of the lower printing unit 96B will be described below. As shown in FIG. 1, the plate handling device 1 comprises a plate recovery unit 5 which recovers an old plate (not shown) removed from a plate gripping portion 3 of the plate cylinder 2, and the loader 7 which supplies a new plate 6 to the plate cylinder 2.

The plate recovery unit 5 comprises a plate removal guide plate 11 fixed to a pair of frames 8 and 9 (FIG. 2) and a pair of coming-out preventive members 12 (one preventive member is not shown). The upper end of the plate removal guide plate 11 is curved, and the upper end of the curved portion is close to the outer surface of the plate cylinder 2.

The coming-out preventive members 12 are arranged at the two ends in the paper widthwise direction of the plate removal guide plate 11 to oppose each other through a gap. The old plate removed from the plate cylinder 2 is guided between the plate removal guide plate 11 and coming-out preventive members 12 and recovered by the plate recovery unit 5. The old plate recovered by the plate recovery unit 5 moves in the loader 7 in a direction of an arrow B and discharged from between the coming-out preventive members 12 in the direction of the arrow B, as will be described later.

Inside the pair of frames 8 and 9, a pair of rails 15 extending in the paper convey direction (directions of an arrow A and the arrow B) are fixed to a bed 15*a*. A pair of base plates 16 are supported to be movable on the rails 15 in the directions of the arrows A and B. A pair of outer frames 17 (support members) extend upright on the base plates 16 to oppose each other.

A rod-less type first air cylinder 18 (first driving means) extending in the directions of the arrows A and B is fixed to the frame 8. One base plate 16 is fixed to a moving element 42 of the first air cylinder 18. When the moving element 42 moves, the base plate 16 moves in the directions of the arrows A and B. Namely, the loader 7 is moved by the first air cylinder 18 substantially horizontally on the rails 15.

The loader 7 comprises a pair of inner frames 20 and 21 which oppose each other through a stud (not shown). The inner frames 20 and 21 are swingably and slidably supported by the outer frames 17 through second and third air cylinders 32 and 40. Thus, the loader 7 is also supported by the outer frames 17 to be swingable and slidable in the longitudinal direction of the loader 7. When the base plates 16 move in the directions of the arrows A and B, the loader 7 also moves in the directions of the arrows A and B.

One inner frame 20 has a slit-like elongated hole 23, as shown in FIG. 1. When the new plate 6 is inserted in the loader 7 from the elongated hole 23, the new plate 6 is stored in a plate storing portion 24 in the loader 7. More specifically, when the bent portion of a leading edge 6*a* of the new plate 6 inserted from the elongated hole 23 is caught on a bar 25 horizontally arranged at the upper end side of the plate storing portion 24, the new plate 6 is stored as it vertically hangs in the plate storing portion 24 with its own weight.

A plate removal/supply switching guide plate 26 which is supported to be swingable about a proximal end 26*a* as a pivot center is pivoted by an air cylinder (not shown) upward/downward (clockwise/counterclockwise in FIG. 1) about the proximal end 26*a* as a pivot center. The bar 25 is fixed to the swing end of the plate removal/supply switching guide plate 26. When the plate removal/supply switching guide plate 26 pivots downward (counterclockwise in FIG. 1) about the proximal end 26*a* as the pivot center, the new plate 6 supported by the bar 25 is able to be supplied to the plate cylinder 2. In this state, a trailing edge 6*b* of the new plate 6 is pushed out toward the plate cylinder 2 by a push-out mechanism (not shown), so the new plate 6 is supplied to the plate cylinder 2.

When the plate removal/supply switching guide plate 26 pivots upward (clockwise) about the proximal end 26*a* as the pivot center (the state shown in FIG. 1), the old plate removed from the plate cylinder 2 is guided to the plate recovery unit 5 by the plate removal/supply switching guide plate 26 and the plate removal guide plates 28 and 29 arranged at the upper end of the loader 7. Regarding the detailed structure of the loader 7 which performs the plate removal operation and plate supply operation described above, the contents described in U.S. Pat. No. 6,802,257 are incorporated in this specification.

The swing structure and slide structure of the loader 7 will be described with reference to FIGS. 4 and 5. Although the swing structure and slide structure are provided to each of the pair of frames 20 and 21 of the loader 7, they have the same arrangement, so only the swing structure and slide structure of the inner frame 20 will be described. Referring to FIG. 5, a pivot shaft 30 horizontally extends between the pair of outer frames 17, and the loader 7 is supported to be pivotal about the pivot shaft 30 as a swing center.

Each second air cylinder 32 (second driving means) has a rod 33. The cylinder end of the air cylinder 32 is pivotally supported by the outer frame 17, and a support plate 34 is pivotally mounted on the end of the rod 33. A flat plate-like intermediate member 35 has one end fixed to the support plate 34 and the other end pivotally supported by the pivot shaft 30. The intermediate member 35 is supported by the pivot shaft 30 and the rod 33 of the air cylinder 32.

Figure 4:
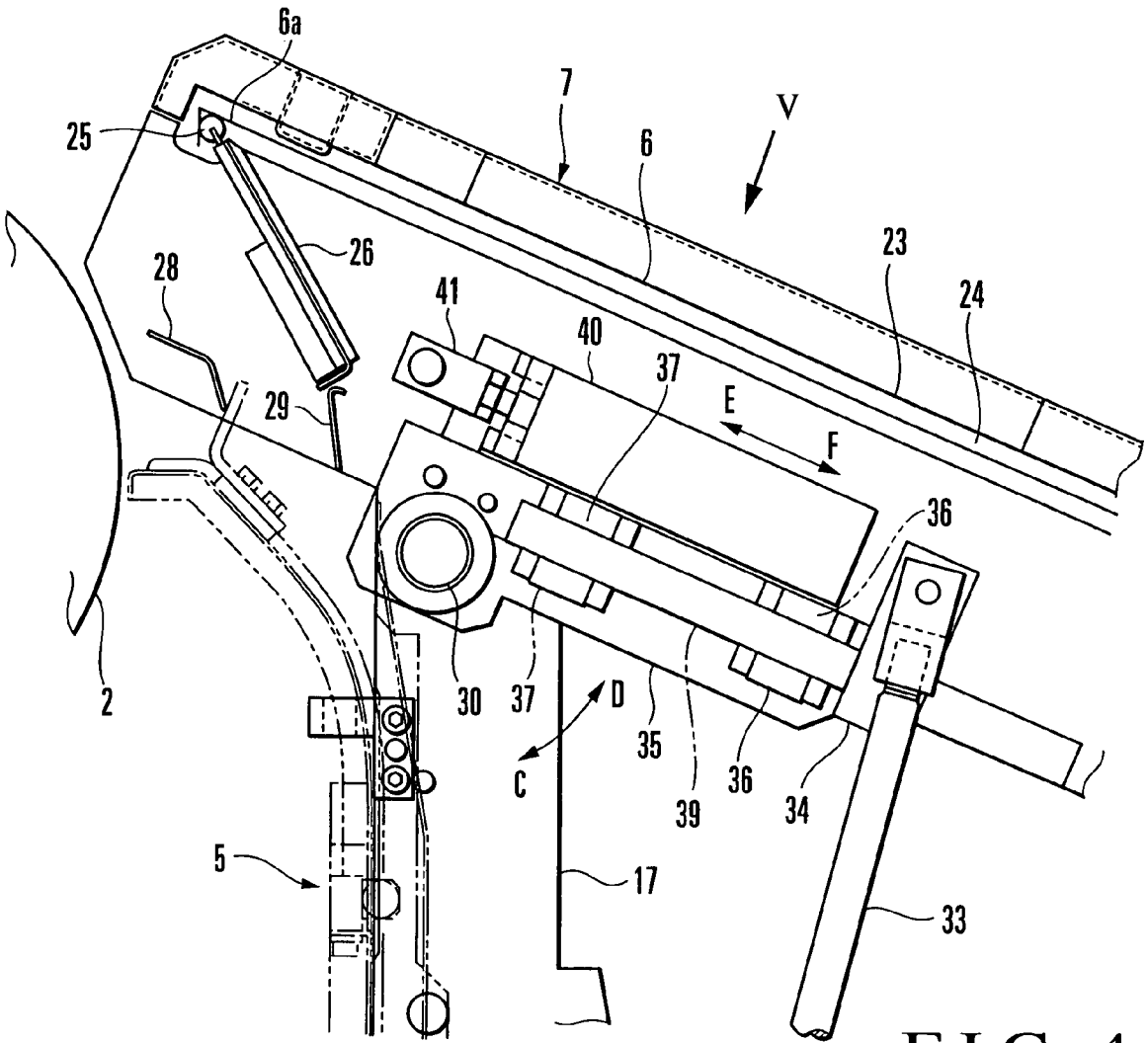
FIG. 4 is an enlarged view of a portion IV of FIG. 1.
Figure 5:
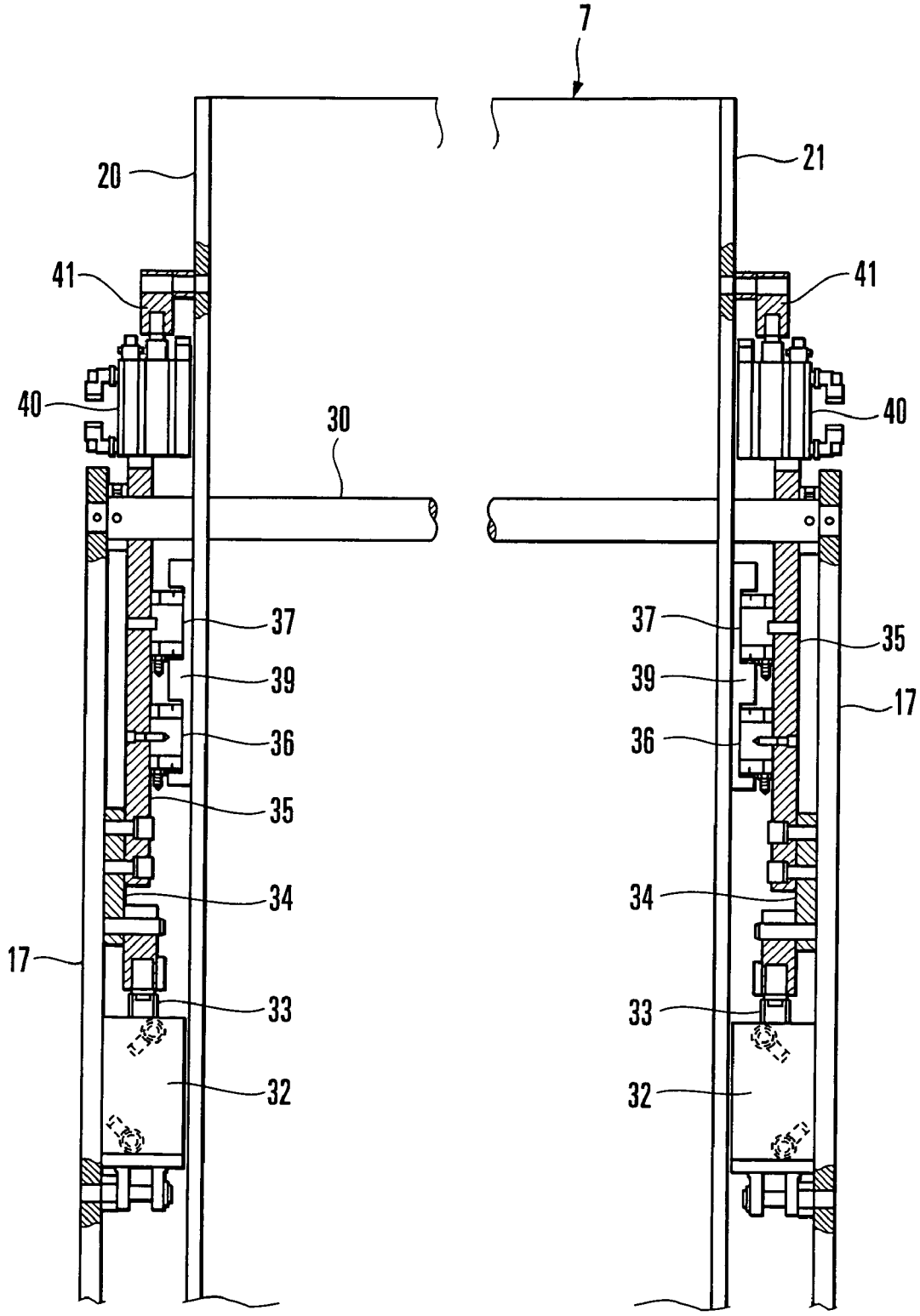
FIG. 5 is a partially sectional view seen from an arrow V of FIG. 4.

When the rod 33 of the air cylinder 32 moves forward/backward, the intermediate member 35 swings in the swing direction (directions of arrows C and D) of the loader 7 about the pivot shaft 30 as a swing center, as shown in FIG. 4. Two sets of slide bearings 36 and 37 (engaging target portions) which oppose each other are fixed to the intermediate member 35. A rail portion 39 (engaging portion) which projects from the inner frame 20 and extends in the longitudinal direction of the loader 7 is fitted in the slide bearings 36 and 37.

The loader 7 is supported by the intermediate member 35 such that it can move (slide) in the directions of the arrows E and F when the two sets of slide bearings 36 and 37 guide the rail portion 39 in the directions of the entire length (directions of arrows E and F) of the loader 7. Each third air cylinder 40 (third driving means) has a rod 41. The cylinder end of the third air cylinder 40 is fixed to the intermediate member 35. The end of the rod 41 is pivotally mounted on the inner frame 20 of the loader 7.

When the rod 41 of the air cylinder 40 moves forward/backward, the loader 7 moves in the directions of the arrows E and F. The loader 7 is also swingably supported by the outer frame 17 through the intermediate member 35. Therefore, when the intermediate member 35 is operated by the air cylinder 32 to swing in the directions of the arrows C and D about the pivot shaft 30 as a swing center, the loader 7 also swings through the intermediate member 35 about the pivot shaft 30 as a swing center.

Namely, the loader 7 is supported by the inner frame 20 through the intermediate member 35 to be swingable in the directions of the arrows C and D about the pivot shaft 30 as a swing center, and slidable in the directions of the arrows E and F.

Figure 6A:
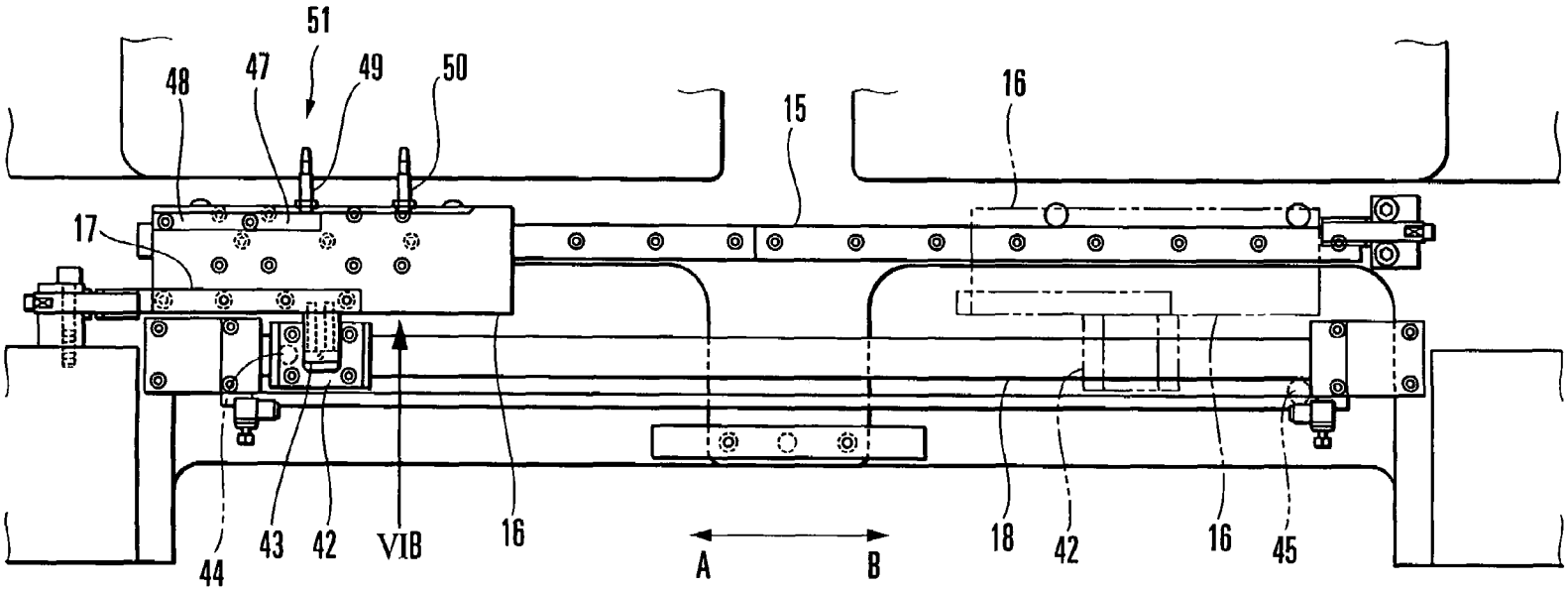
FIG. 6A is a sectional view taken along the line VIA-VIA of FIG. 3.

The first detection unit which detects the position of the loader in the directions of the arrows A and B will be described with reference to FIG. 3 and FIGS. 6A and 6B. The air cylinder 18 includes the moving element 42 which moves in the directions of the arrows A and B. The base plate 16 is fixed to the moving element 42 through a pin 43. When the moving element 42 moves in the directions of the arrows A and B, the base plate 16 also moves in the directions of the arrows A and B, and accordingly the loader 7 moves integrally in the directions of the arrows A and B.

Figure 10A:
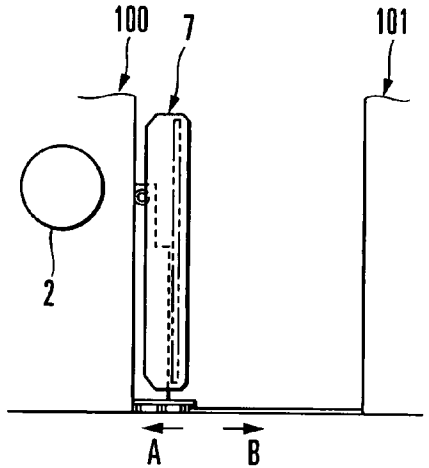
FIGS. 10A to 10F are views for explaining operation until plate exchange.
Figure 10B:
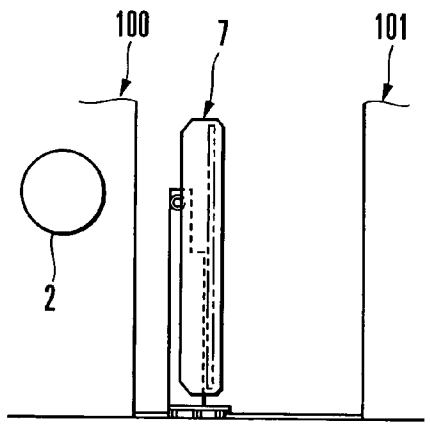

The air cylinder 18 further includes first and second autoswitches 44 and 45 (first and second state detection switches in claim 12). The first autoswitch 44 detects that the moving element 42 has located at the moving end limit in the direction of the arrow A. At this time, the loader 7 is located at the "first position" close to the printing unit 100, as shown in FIG. 10A. The second autoswitch 45 detects that the moving element 42 has located at the moving end limit in the direction of the arrow B. At this time, the loader 7 is located at the "second position" spaced part from the printing unit 100 and close to the adjacent printing unit 101, as shown in FIG. 11F. The loader 7 can also be located at the "third position" between the "first position" and "second position", as shown in FIG. 10B.

Figure 6B:
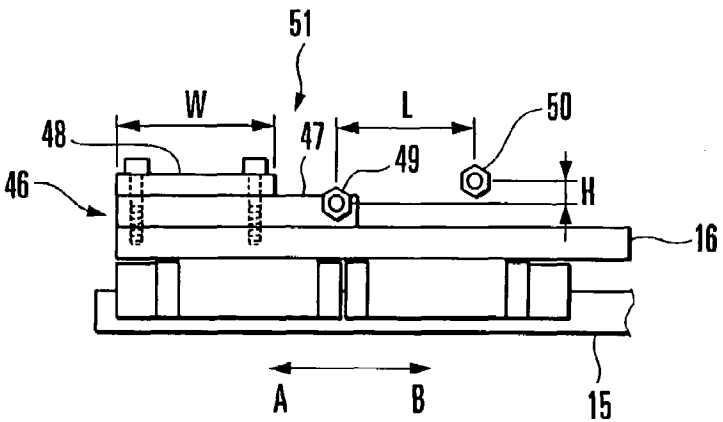
FIG. 6B is a view seen from an arrow VIB of FIG. 6A.

A detection target member 46 is fixed on the base plate 16, as shown in FIG. 6B. The detection target member 46 comprises a first detection target element 47 (first detection target portion in claims 9 to 13) fixed to the base plate 16 and a second detection target element 48 (second detection target portion in claims 9 to 13) fixed on the first detection target element 47. The first detection target element 47 is arranged to project more in the direction of the arrow B than the second detection target element 48 having a length "W". First and second proximity switches 49 and 50 (first and second stationary switches in claims 9 to 13) are attached to a bracket (not shown) fixed to the frame 8. The second proximity switch 50 is arranged at a position higher than the first proximity switch 49 by "H" and spaced apart from the proximity switch 49 by a length "L" in the direction of the arrow B.

The first detection target element 47 is kept detected by the proximity switch 49 since the loader 7 is located from the "first position" to the "third position". The second detection target element 48 is detected by the proximity switch 50 when the loader 7 is located at the "third position".

The range of the "third position" of the loader 7 in the directions of the arrows A and B has a length in which the loader 7 moves in the directions of the arrows A and B and the second detection target element 48 is detected by the proximity switch 50, i.e., a length corresponding to the length "W" of the second detection target element 48. The first and second detection target elements 47 and 48 and the first and second proximity switches 49 and 50 form a first detection unit 51.

When the loader 7 is located between the "third position" and "first position", the first proximity switch 49 detects the first detection target element 47, and the second proximity switch 50 does not detect the second detection target element 48. When the loader 7 is located between the "third position" and "second position", the first proximity switch 49 does not detect the first detection target element 47, and the second proximity switch 50 does not detect the second detection target element 48 either.

In other words, the first detection unit 51 detects that the loader 7 is located at the "third position" and that the loader 7 is between the "third position" and "first position" and between the "third position" and "second position".

The second detection unit which detects the swing state of the loader 7 in the directions of the arrows C and D will be described with reference to FIGS. 1, 3, 7A, and 7B. As shown in FIG. 3, the air cylinder 32 includes a third autoswitch 53 (first state detection switch of claim 17) which detects the first moving end limit of the rod 33 as it has moved backward and a fourth autoswitch 54 (second state detection switch of claim 17) which detects the second moving end limit of the rod 33 as it has moved forward.

Figure 10C:
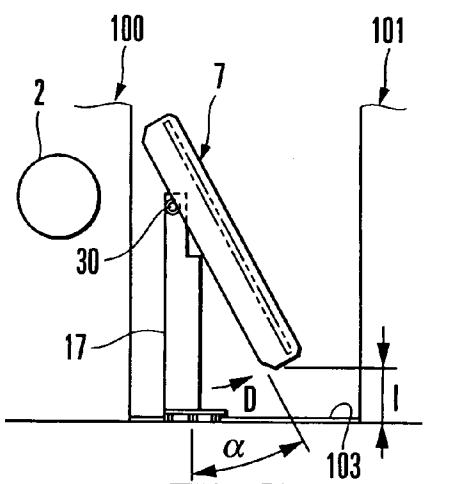
Figure 10D:
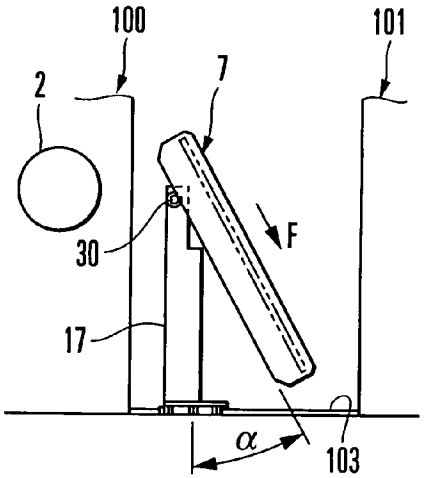

When the rod 33 of the air cylinder 32 moves backward to be located at the first moving end limit, the loader 7 is set in the vertical "first swing state" as indicated by an alternate long and short dashed line in FIG. 1. When the rod 33 of the air cylinder 32 moves forward to be located at the second moving end limit, the loader 7 is set in the "second swing state" where it is inclined from the "first swing state" at an angle $\beta$, as indicated by a solid line in FIG. 1. The rod 33 is set in the swing state between the "first swing state" and "second swing state", that is, the "third swing state" where it is inclined from the "first swing state" by an angle $\alpha$, as shown in FIG. 10C.

Figure 7A:
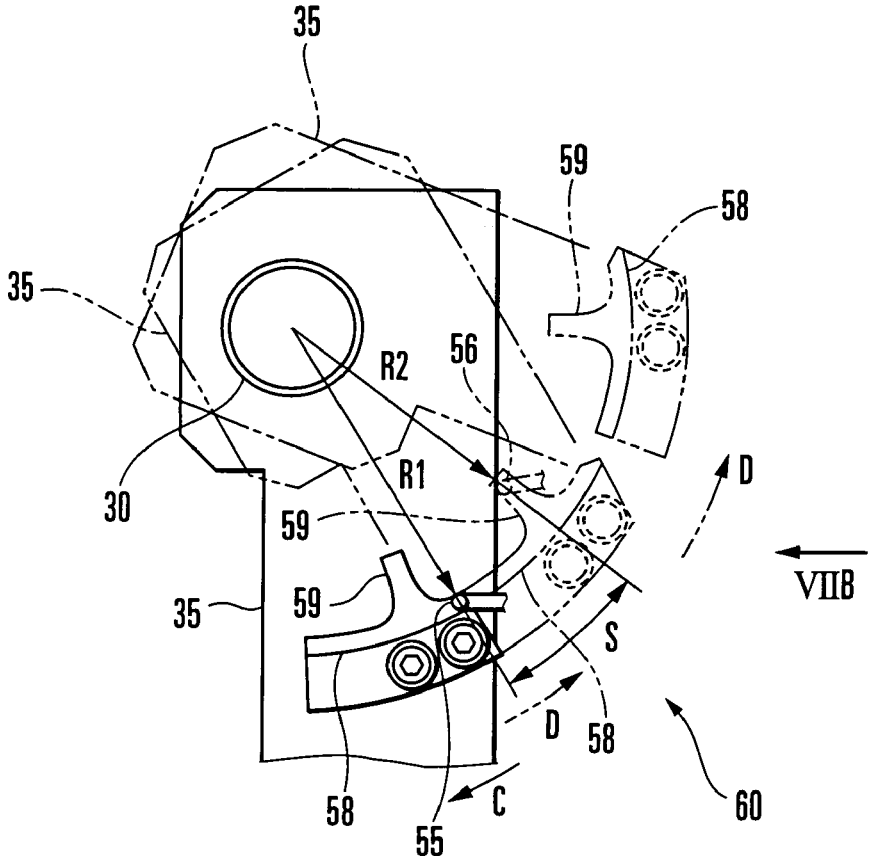
FIG. 7A is an enlarged view of a portion VIIA of FIG. 3.
Figure 7B:
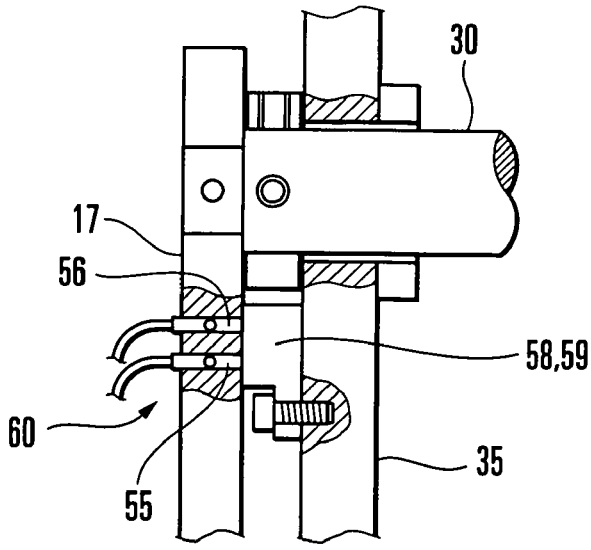
FIG. 7B is a view seen from an arrow VIIB of FIG. 7A.

As shown in FIG. 7B, third and fourth proximity switches 55 and 56 are fixed to the outer frames 17. As shown in FIG. 7A, distances R1 and R2 from the third and fourth proximity switches 55 and 56 to the pivot shaft 30 are set to satisfy R1>R2. The third and fourth proximity switches 55 and 56 are arranged to be spaced apart from each other by a gap "S" in the swing directions (directions of the arrows C and D) of the intermediate member 35.

An arcuate third detection target member 58 (first detection target portion in claims 14 to 18) is fixed to the intermediate member 35. The third detection target member 58 is arranged to be spaced apart from the pivot shaft 30 by the distance "R1". A fourth detection target portion 59 (second detection target portion in claims 14 to 18) projects from the third detection target member 58 toward the pivot shaft 30. The fourth detection target portion 59 is spaced apart from the pivot shaft 30 by the distance "R2".

A third proximity switch 55 (first stationary switch in claims 14 to 18) detects the third detection target member 58 when the loader 7 is between the "first swing state" and "third swing state". A fourth proximity switch 56 (second stationary switch in claims 14 to 18) detects the fourth detection target portion 59 when the loader 7 is in the "third swing state". The third and fourth detection target members 58 and 59 and the third and fourth proximity switches 55 and 56 form a second detection unit 60.

When the loader 7 is between the "third swing state" and "first swing state", the third proximity switch 55 detects the third detection target member 58, and the fourth proximity switch 56 does not detect the fourth detection target portion 59. When the loader 7 is between the "third swing state" and "second swing state", the third proximity switch 55 does not detect the third detection target member 58, and the fourth proximity switch 56 does not detect the fourth detection target portion 59, either.

In other words, the second detection unit 60 detects that the loader 7 is located in the "third swing state" and that the loader 7 is between the "third swing state" and "first swing state" and between the "third swing state" and "second swing state".

Figure 3:
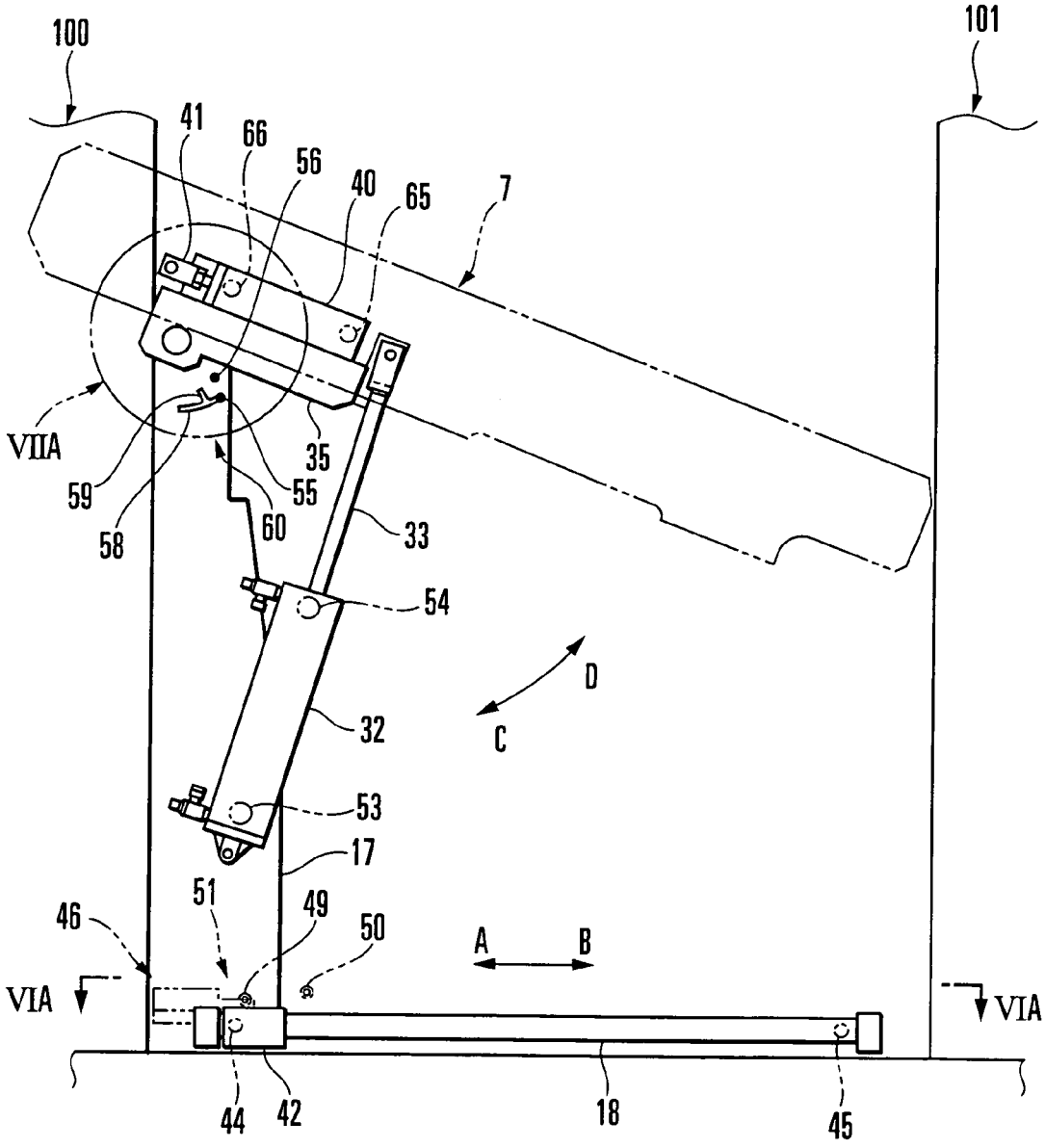
FIG. 3, is a view showing the positions of switches provided to the plate handling apparatus shown in FIG. 1.

As shown in FIG. 3, the air cylinder 40 includes a fifth autoswitch 65 which detects the moving end limit of the rod 41 as it has moved backward, and a sixth autoswitch 66 which detects the moving end limit of the rod 41 as it has moved forward.

Figure 8:
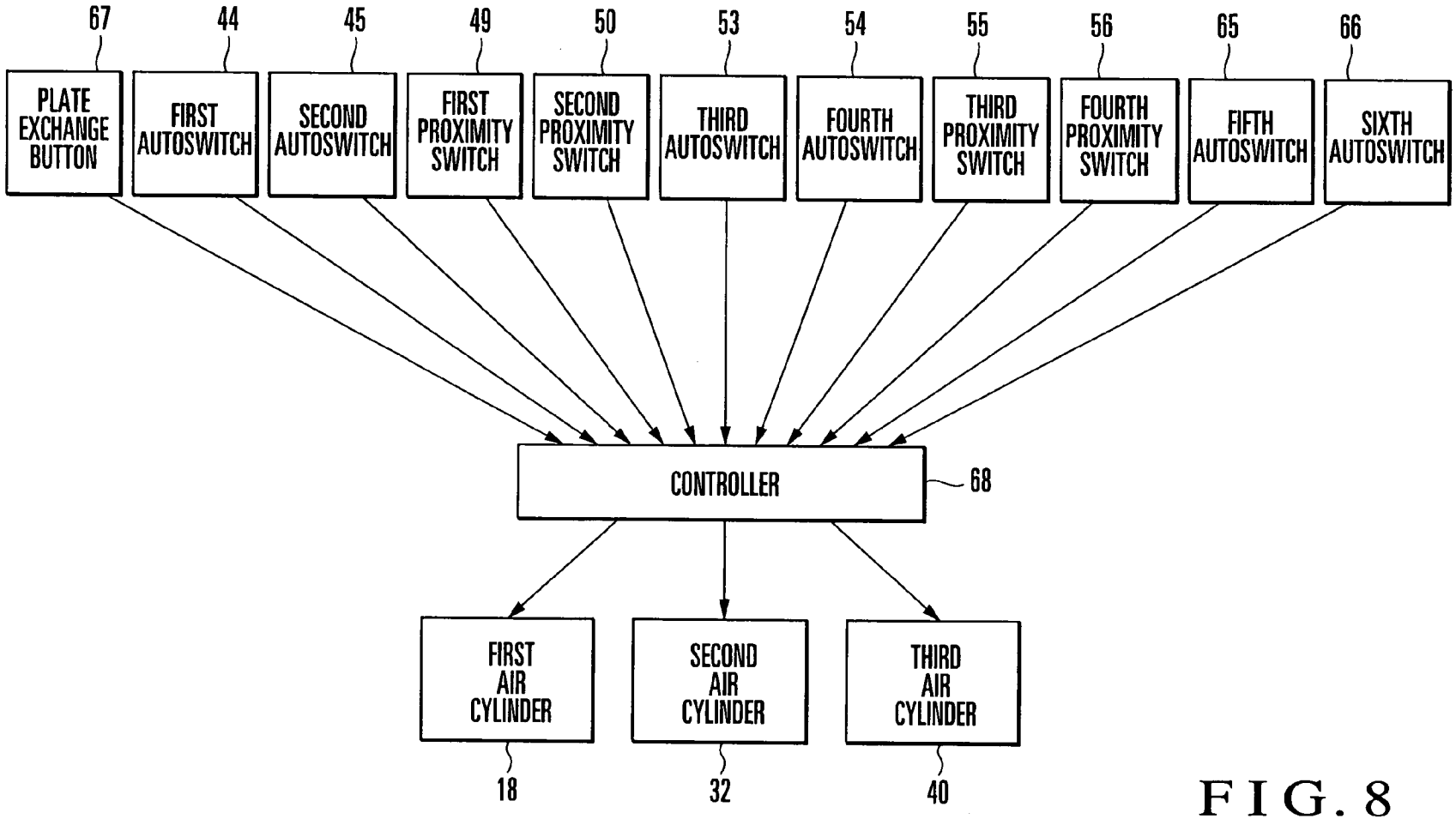
FIG. 8 is a block diagram showing the electrical arrangement of the plate handling apparatus according to the present invention.

As shown in FIG. 8, a controller 68 is connected to the first to third air cylinders 18, 32, and 40, the first to sixth autoswitches 44, 45, 53, 54, 65, and 66, the first to fourth proximity switches 49, 50, 55, and 56, and a plate change button 67 which is operated when performing plate exchange. The controller 68 controls the first to third air cylinders 18, 32, and 40 on the basis of signals from the first to fourth proximity switches 49, 50, 55, and 56 and from the first to sixth autoswitches 44, 45, 53, 54, 65, and 66.

Figure 9C:
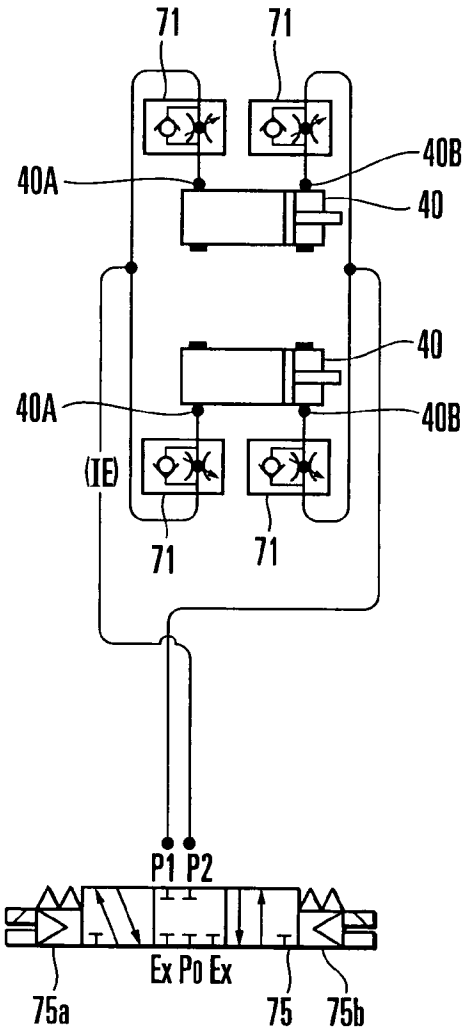
FIGS. 9A to 9C are circuit diagrams of hydropneumatic cylinders.

An air supply switching device which supplies air to the air cylinders 18, 32, and 40 that move, swing, and slide the loader 7 will be described with reference to FIGS. 9A to 9C. Referring to FIG. 9A, a first air cylinder driving solenoid valve 70 which drives the first air cylinder 18 includes three ports P0, P1, and P2. Air is supplied to the port P0 from a pump (not shown).

The port P1 is connected to a port 18A, which moves the moving element 42 of the air cylinder 18 in the direction of the arrow B, through a throttle valve 71 with a check valve. The port P2 is connected to a port 18B, which moves the moving element 42 of the air cylinder 18 in the direction of the arrow A, through a throttle valve 71 with a check valve.

When one solenoid 70*a* of the air cylinder driving solenoid valve 70 operates, the port P1 is connected to the port P0 and the port P2 is opened to the atmosphere. When the other solenoid 70*b* of the air cylinder driving solenoid valve 70 operates, the port P2 is connected to the port P0 and the port P1 is opened to the atmosphere.

When the two solenoids 70*a* and 70*b* do not operate, the air cylinder driving solenoid valve 70 is set in the neutral mode, and air discharge from the ports P1 and P2 is regulated by a spring (not shown). Namely, the first air cylinder driving solenoid valve 70 is a double-solenoid, center spring type solenoid valve which can be switched among three positions.

With this arrangement, the air cylinder driving solenoid valve 70 can position the loader 7 at three positions, i.e., the "first position", "second position", and "third position". Since one solenoid valve can control the three positions of the loader 7, the structure can be simplified. Also, the apparatus can be downsized, and the manufacturing cost can be reduced.

Figure 9B:
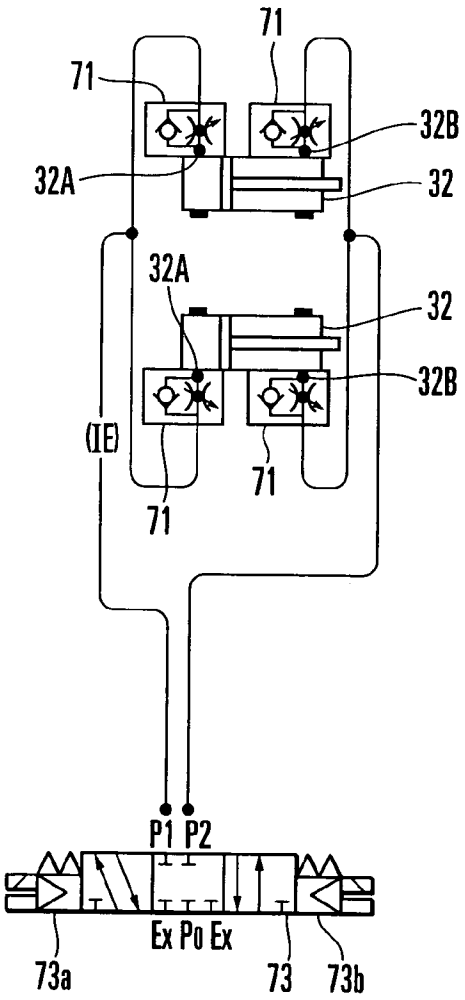
Figure 9A:
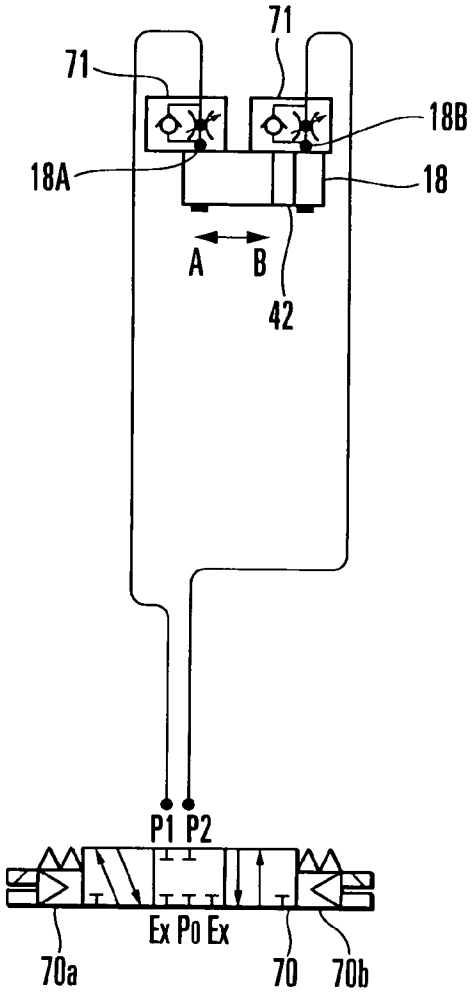

Referring to FIG. 9B, a second air cylinder driving solenoid valve 73 which drives the second air cylinder 32 includes three ports P1, P2, and P0. Air is supplied to the port P0 from a pump (not shown). The port P1 is connected to an end-side port 32A of the air cylinder 32 through a throttle valve 71 with a check valve. The port P2 is connected to a rod-side port 32B of the air cylinder 18 through a throttle valve 71 with a check valve.

When one solenoid 73*a* of the air cylinder driving solenoid valve 73 operates, the port P1 is connected to the port P0 and the port P2 is opened to the atmosphere. When the other solenoid 73*b* of the air cylinder driving solenoid valve 73 operates, the port P2 is connected to the port P0 and the port P1 is opened to the atmosphere.

When the two solenoids 73*a* and 73*b* do not operate, the air cylinder driving solenoid valve 73 is set in the neutral mode, and air discharge from the ports P1 and P2 is regulated by a spring (not shown). Namely, the second air cylinder driving solenoid valve 73 is a double-solenoid, center spring type solenoid valve which can be switched among three positions.

With this arrangement, the air cylinder driving solenoid valve 73 can set the loader 7 in three swing states, i.e., the "first swing state", "second swing state", and "third swing state". Since one solenoid valve can control the three swing states of the loader 7, the structure can be simplified. Also, the apparatus can be downsized, and the manufacturing cost can be reduced.

Referring to FIG. 9C, a third air cylinder driving solenoid valve 75 which drives the third air cylinder 40 includes three ports P1, P2, and P0. Air is supplied to the port P0 from a pump (not shown). The port P1 is connected to rod-side ports 40B of the air cylinder 32 through throttle valves 71 with check valves. The port P2 is connected to end-side ports 40A of the air cylinder 18 through throttle valves 71 with check valves.

When one solenoid 75*a* of the air cylinder driving solenoid valve 75 operates, the port P1 is connected to the port P0 and the port P2 is opened to the atmosphere. When the other solenoid 75*b* of the air cylinder driving solenoid valve 75 operates, the port P2 is connected to the port P0 and the port P1 is opened to the atmosphere.

When the two solenoids 75*a* and 75*b* do not operate, the air cylinder driving solenoid valve 75 is set in the neutral mode, and air discharge from the ports P1 and P2 is regulated by a spring (not shown). Namely, the third air cylinder driving solenoid valve 75 is a double-solenoid, center spring type solenoid valve which can be switched among three positions.

Plate exchange operation in the plate handling apparatus having the above arrangement will be described with reference to FIGS. 10A to 12B. Referring to FIG. 12A, ON of the plate change button 67 is detected (step S1). When the second proximity switch 50 detects the second detection target element 48 (step S2), it is recognized in the initial state that the loader 7 is located at the "third position".

If "NO" in step S2, when the first proximity switch 49 detects the first detection target element 47 (step S3), it is recognized that the loader 7 is located in the direction of the arrow A from the "third position". Then, the moving element 42 of the first air cylinder 18 moves in the direction of the arrow B to move the loader 7 in the direction of the arrow B (step S4). Namely, the controller 68 sets one solenoid 70*a* (FIG. 9A) of the first air cylinder driving solenoid valve 70 in the operative state. Thus, the port P1 is connected to the port P0, and the port P2 is opened to the atmosphere, so the moving element 42 moves in the direction of the arrow B.

When the second proximity switch 50 detects the second detection target element 48 (step S5), it is recognized that the loader 7 is located at the "third position". In response to this, the controller 68 cancels the operative state of one solenoid 70*a* of the first air cylinder driving solenoid valve 70. Thus, the first air cylinder driving solenoid valve 70 is set in the neutral mode, and the state wherein the loader 7 is located at the "third position" is held, as shown in FIG. 10B. If "NO" in step S5, the loader 7 is kept moving in the direction of the arrow B through the moving element 42 of the first air cylinder 18 until the second proximity switch 50 detects the second detection target element 48.

If "NO" in step S3, it is recognized that the loader 7 is located in the direction of the arrow B from the "third position". Therefore, the moving element 42 of the first air cylinder 18 moves in the direction of the arrow A (step S6) so as to move the loader 7 in the direction of the arrow A. Namely, the controller 68 sets the other solenoid 70*b* (FIG. 9A) of the first air cylinder driving solenoid valve 70 in the operative state. Thus, the port P2 is connected to the port P0, and the port P1 is opened to the atmosphere, so the moving element 42 moves in the direction of the arrow A.

When the second proximity switch 50 detects the second detection target element 48 (step S7), it is recognized that the loader 7 has located at the "third position". In response to this, the controller 68 cancels the operative state of the other solenoid 70*b* of the first air cylinder driving solenoid valve 70. Accordingly, the first air cylinder driving solenoid valve 70 is set in the neutral mode, and the state wherein the loader 7 is located at the "third position" is held, as shown in FIG. 10B.

If "NO" in step S7, the loader 7 is kept moving in the direction of the arrow A through the moving element 42 of the first air cylinder 18 until the second proximity switch 50 detects the second detection target element 48.

In this manner, wherever the loader 7 may be located after maintenance, it can be reliably positioned at the "third position" by the first detection unit 51, as shown in FIG. 10B. In positioning the loader 7 at the "third position", the loader 7 is moved to the "third position" directly not via the "first position". This can shorten the plate exchange time.

When the movement of the loader 7 to the "third position" is ended, the rod 33 of the second air cylinder 32 extends (step S8). Namely, the controller 68 sets one solenoid 73*a* (FIG. 9B) of the second air cylinder driving solenoid valve 73 in the operative state. Thus, the port P1 is connected to the port P0, and the port P2 is opened to the atmosphere, so the rod 33 of the second air cylinder 32 moves forward.

When the fourth proximity switch 56 of the second detection unit 60 detects the fourth detection target portion 59 (step S9), the loader 7 pivots in the direction of the arrow D by the angle α, as shown in FIG. 10C, so it is recognized that the loader 7 is set in the "third swing state". In response to this, the controller 68 sets one solenoid 73*a* of the second air cylinder driving solenoid valve 73 in the inoperative state. Hence, the second air cylinder driving solenoid valve 73 is set in the neutral mode, and the "third swing state" of the loader 7 is held.

In step S9, if the fourth proximity switch 56 of the second detection unit 60 does not detect the fourth detection target portion 59, the rod 33 of the second air cylinder 32 keeps extending until the detection target portion 59 is detected. At this time, if the swing position of the loader 7 is shifted from the "third swing state" in the direction of the arrow C, the third proximity switch 55 detects the third detection target member 58, and the fourth proximity switch 56 does not detect the fourth detection target portion 59, as shown in FIG. 7A.

In this case, the controller 68 sets one solenoid 73*a* of the second air cylinder driving solenoid valve 73 in the operative state. Thus, the port P1 of the second air cylinder driving solenoid valve 73 is connected to the port P0, and the port P2 is opened to the atmosphere. As a result, the rod 33 keeps moving forward until the fourth proximity switch 56 detects the fourth detection target portion 59.

If the fourth detection target member 58 exceeds the fourth proximity switch 56 and the swing position of the loader 7 is shifted from the "third swing position" in the direction of the arrow D, the third proximity switch 55 does not detect the third detection target member 58, and the fourth proximity switch 56 does not detect the fourth detection target portion 59. In this case, the controller 68 sets the other solenoid 73*b* of the third air cylinder driving solenoid valve 73 in the operative state.

Thus, the port P2 of the third air cylinder driving solenoid valve 73 is connected to the port P0 and the port P1 is opened to the atmosphere. As a result, the rod 33 keeps moving backward until the fourth proximity switch 56 detects the fourth detection target portion 59. In this manner, the loader 7 is reliably set in the "third swing state" by the second detection unit 60.

As shown in FIG. 10*c*, even when the loader 7 located at the "third position" spaced apart from the printing unit 100 is inclined at the angle α in the "third swing state", the upper end of the loader 7 does not enter the printing unit 100. Therefore, even when the plate size increases and the entire length of the loader 7 increases, the upper end of the loader 7 does not come into contact with an ink roller or the like in the printing unit 100, so the ink roller or the like can be prevented from being damaged by the upper end of the loader 7. Since the loader 7 is inclined at the angle α so as to be set in the "third swing state", a gap I can be ensured between the lower end of the loader 7 and floor 103.

After the loader 7 is set in the "third swing state", the rod 41 of the third air cylinder 40 is retracted (step S10). More specifically, the controller 68 sets one solenoid 75*a* (FIG. 9C) of the third air cylinder driving solenoid valve 75 in the operative state. Thus, the port P1 is connected to the port P0, and the port P2 is opened to the atmosphere, so the rod 41 of the third air cylinder 40 is moved backward.

Figure 10E:
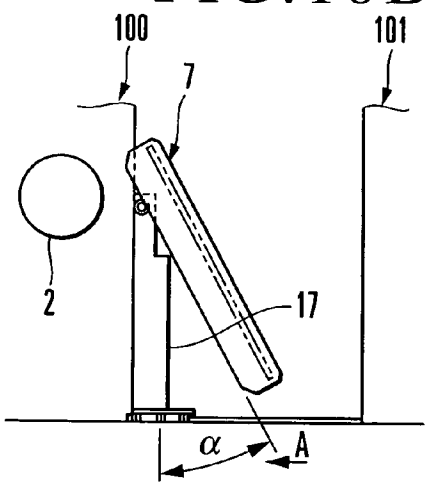
Figure 10F:
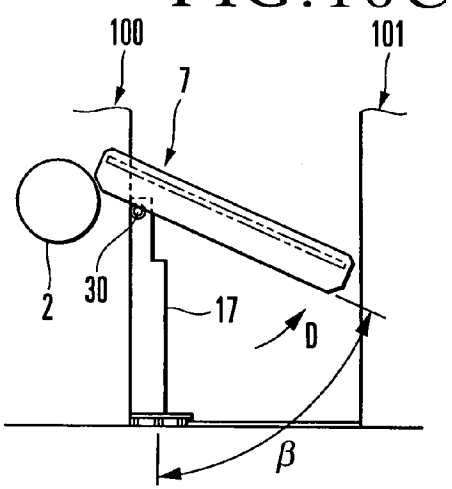

When the fifth autoswitch 65 in the second air cylinder 40 detects that the rod 41 has moved backward to the moving end limit (step S11), it is recognized that the loader 7 has moved in the direction of the arrow F, as shown in FIG. 10F. The controller 68 sets one solenoid 75*b* (FIG. 9C) of the third air cylinder driving solenoid valve 75 in the inoperative state, so the third air cylinder driving solenoid valve 75 is set in the neutral mode. Thus, the rod 41 is held as it has moved backward to the moving end limit. Even in this state, the gap I is ensured between the lower end of the loader 7 and the floor 103, as shown in FIG. 10C. Thus, the lower end of the loader 7 does not come into contact with the floor 103.

Therefore, even when the plate size increases and the entire length of the loader 7 increases, the lower end of the loader 7 does not abut against the floor 103. Thus, an increase in plate size can be coped with without increasing the size of the printing unit 100.

If "NO" in step S11, the rod 41 of the third air cylinder 40 keeps retracting until the fifth autoswitch 65 in the third air cylinder 40 detects the rod 41. Then, the moving element 42 of the first air cylinder 18 moves in the direction of the air cylinder 18 (step S12). Namely, the controller 68 sets the other solenoid 70*b* (FIG. 9A) of the first air cylinder driving solenoid valve 70 in the operative state. Thus, the port P2 is connected to the port P0, and the port P1 is opened to the atmosphere, so the moving element 42 is moved in the direction of the arrow A.

When the moving element 42 moves to the moving end limit in the direction of the arrow A, the first autoswitch 44 in the first air cylinder 18 detects the moving element 42 (step S13). The controller 68 sets the other solenoid 70*b* (FIG. 9A) of the first air cylinder driving solenoid valve 70 in the inoperative state, so the first air cylinder driving solenoid valve 70 is set in the neutral state. Therefore, as shown in FIG. 10E, the loader 7 is located at the "first position" close to the printing unit 100 while it is held in the "third swing state".

If "NO" in step S13, the moving element 42 of the first air cylinder 18 keeps moving in the direction of the arrow A until the first autoswitch 44 in the first air cylinder 18 detects the moving element 42. Then, the rod 33 of the second air cylinder 32 extends (step S14). Namely, the controller 68 sets one solenoid 73*a* (FIG. 9B) of the second air cylinder driving solenoid valve 73 in the operative state. Thus, the port P1 is connected to the port P0 and the port P2 is opened to the atmosphere. As a result, the rod 33 of the second air cylinder 32 moves forward until the moving end limit.

When the loader 7 pivots by the angle β in the direction of the arrow D, as shown in FIG. 10F, the fourth autoswitch 54 in the second air cylinder 32 detects the rod 33 (step S15). When the loader 7 pivots by the angle β, the upper end of the loader 7 comes close to the outer surface of the plate cylinder 2, so the old plate can be removed and the new plate can be supplied. The controller 68 sets one solenoid 73*a* of the second air cylinder driving solenoid valve 73 in the inoperative state. Thus, the second air cylinder driving solenoid valve 73 is set in the neutral mode, so the loader 7 is held in the "second swing state".

If "NO" in step S15, the rod 33 in the second air cylinder 32 keeps extending until the fourth autoswitch 54 in the second air cylinder 32 detects the rod 33. When the loader 7 is held in the "second swing state", the trailing edge of the old plate is removed from the plate gripping portion 3 of the plate cylinder 2, and the plate cylinder 2 is rotated substantially through one revolution in the opposite direction (clockwise in FIG. 1), as shown in FIG. 1. Hence, the old plate removed from the plate cylinder 2 is guided to the plate recovery unit 5 by the plate removal/supply switching guide plate 26 and plate removal guide plates 28 and 29.

When plate removal is ended, the plate removal/supply switching guide plate 26 is pivoted by an air cylinder (not shown) counterclockwise in FIG. 1 about the proximal end 26*a* as a pivot center, so the new plate 6 supported by the bar 25 can be supplied to the plate cylinder 2. In this state, the trailing edge 6*b* of the new plate 6 is pushed out toward the plate cylinder 2 by a push-out mechanism (not shown), so the new plate 6 is supplied to the plate cylinder 2.

Figure 11A:
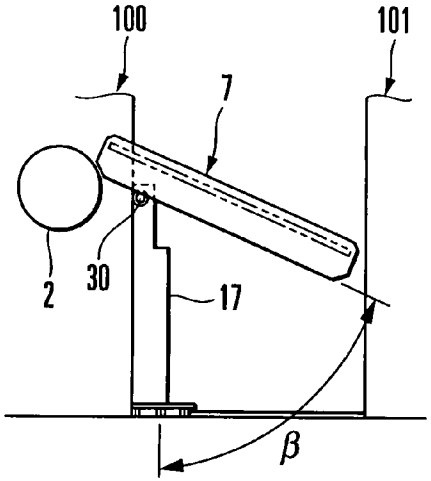
FIGS. 11A to 11F are views for explaining operation after plate exchange.
Figure 12A:
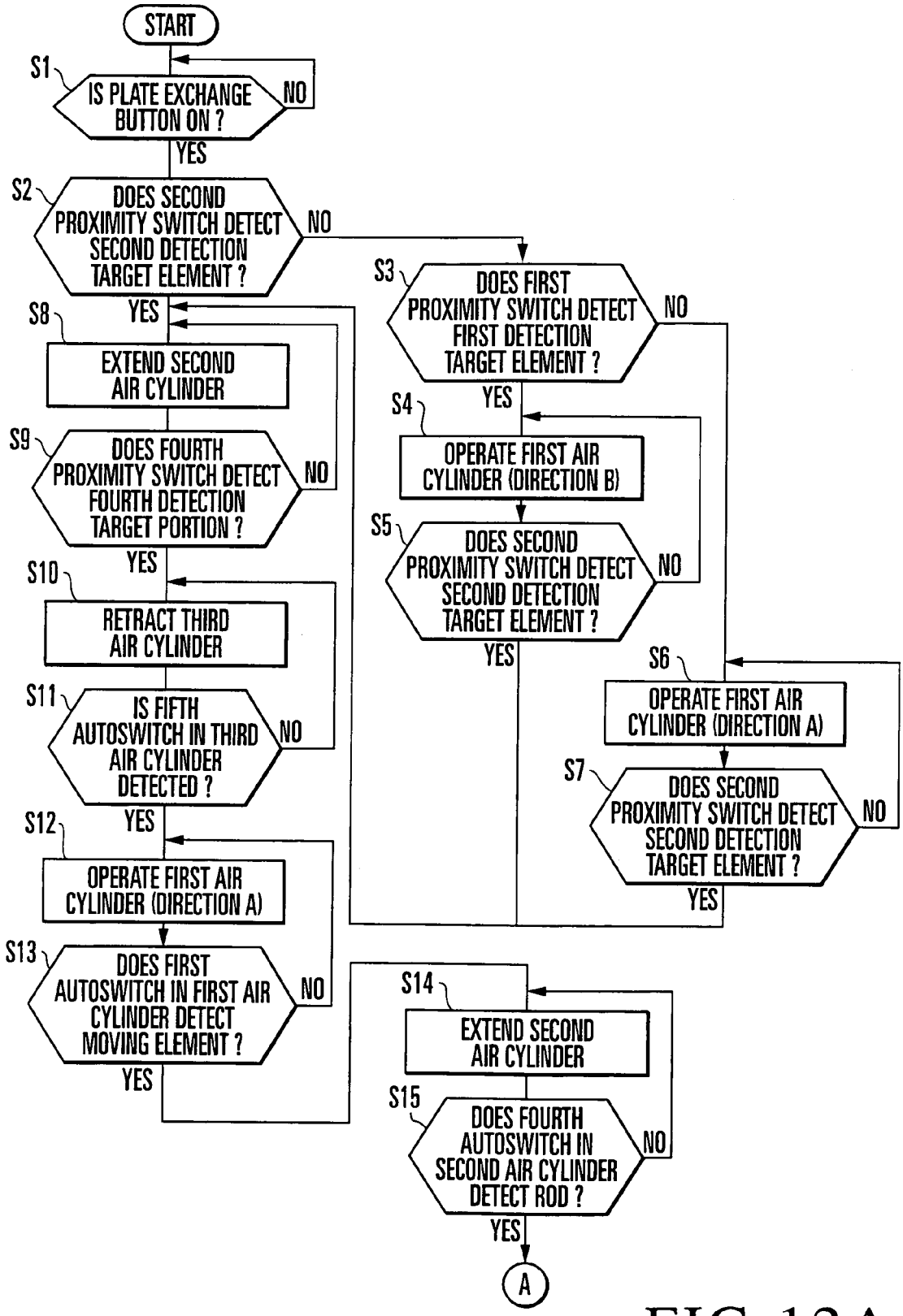
FIGS. 12A and 12B are flowcharts showing plate exchange operation.
Figure 12B:
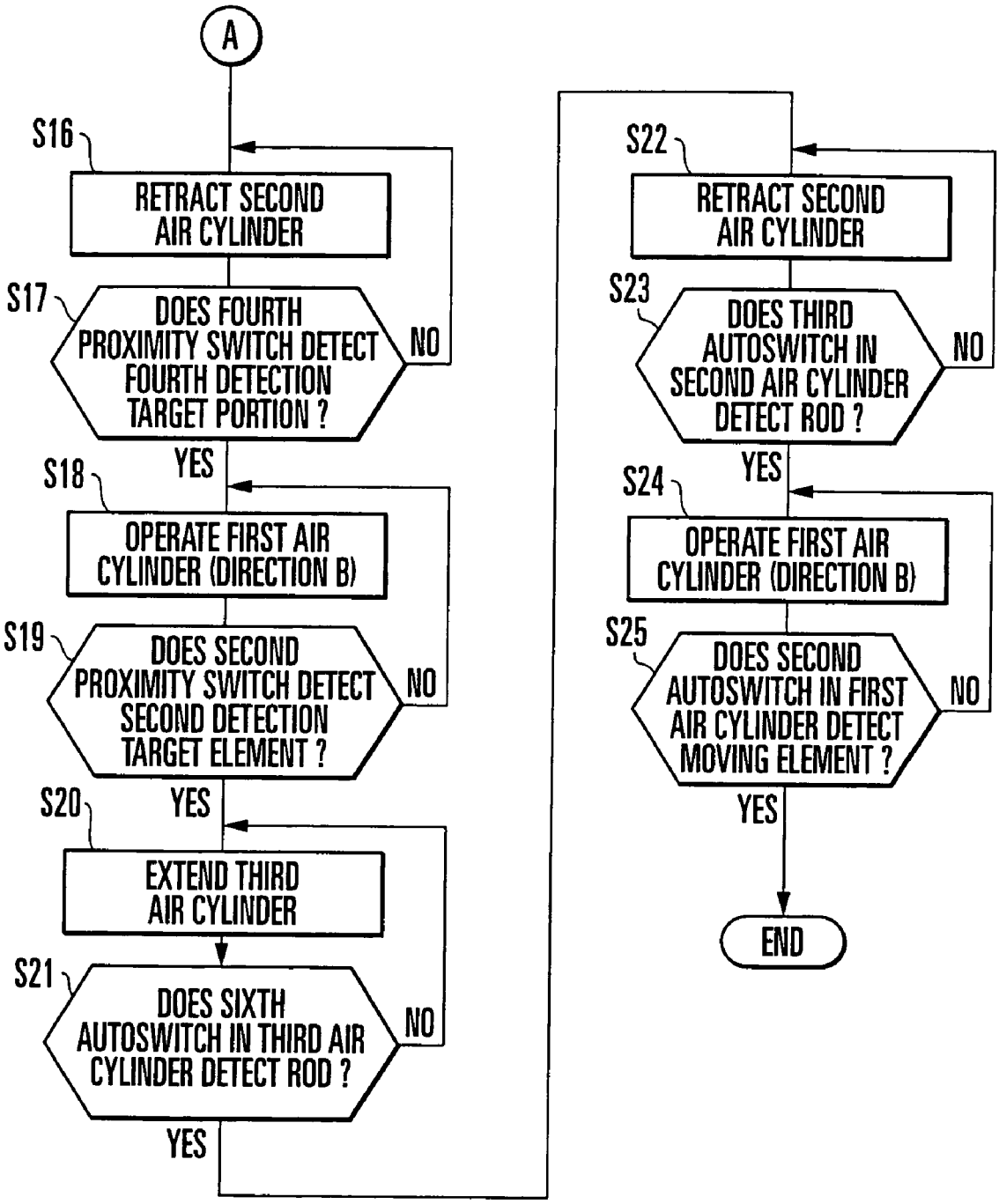

When the plate exchange described above is ended, the rod 33 of the second air cylinder 32 retracts in the state shown in FIG. 11A (step S16). Namely, the controller 68 sets the other solenoid 73*b* (FIG. 9B) of the second air cylinder driving solenoid valve 73 in the operative state. Hence, the port P2 is connected to the port P0, and the port P1 is opened to the atmosphere, so the rod 33 of the second air cylinder 32 moves backward.

Figure 11B:
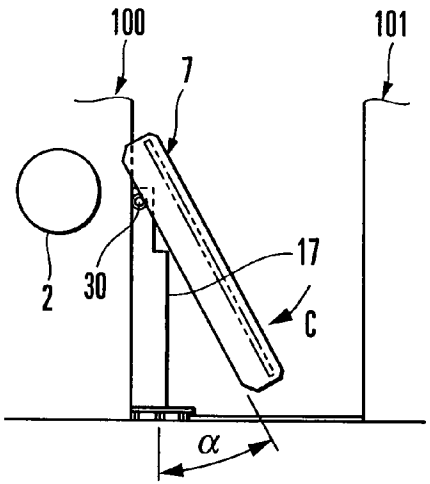

When the loader 7 pivots in the direction of the arrow C and is set at the angle α, as shown in FIG. 11B, the fourth proximity switch 56 of the second detection unit 60 detects the fourth detection target portion 59 (step S17). The controller 68 sets one solenoid 73*a* of the second air cylinder driving solenoid valve 73 in the inoperative state. Thus, the second air cylinder driving solenoid valve 73 is set in the neutral mode, and the loader 7 is set in the "third swing state". If "NO" in step S17, the rod 33 of the second air cylinder 32 keeps retracting until the fourth proximity switch 56 of the second detection unit 60 detects the fourth detection target portion 59.

Then, the moving element 42 of the first air cylinder 18 moves in the direction of the arrow B (step S18). Namely, the controller 68 sets one solenoid 70*a* (FIG. 9A) of the first air cylinder driving solenoid valve 70 in the operative state. Thus, the port P1 is connected to the port P0, and the port P2 is opened to the atmosphere, so the moving element 42 moves in the direction of the arrow B.

Figure 11C:
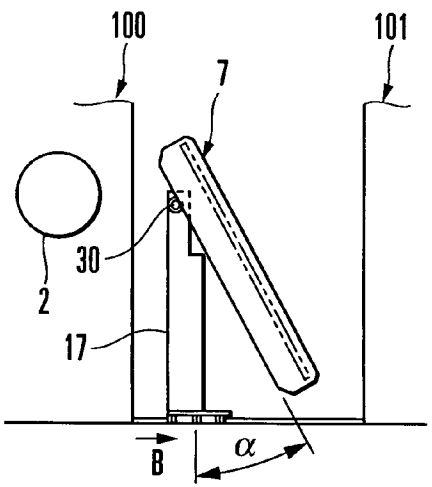
Figure 11D:
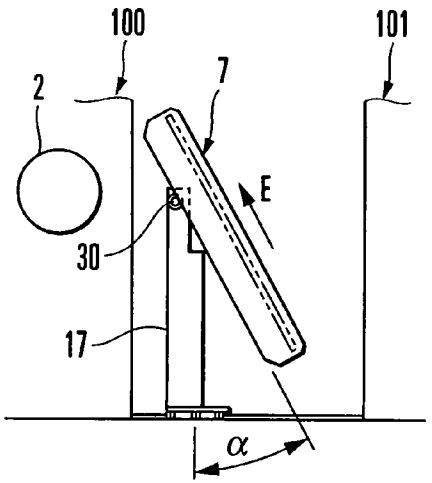

When the second proximity switch 50 detects the second detection target element 48 (step S19), the controller 68 sets one solenoid 70*a* of the first air cylinder driving solenoid valve 70 in the inoperative state. Thus, the first air cylinder driving solenoid valve 70 is set in the neutral mode, and the state wherein the loader 7 is located at the "third position" is held, as shown in FIG. 11C. If "NO" in step S19, the moving element 42 of the first air cylinder 18 keeps moving in the direction of the arrow B until the second proximity switch 50 detects the second detection target element 48.

Then, the rod 41 of the third air cylinder 40 extends (step S20). Namely, the controller 68 sets the other solenoid 75*b* (FIG. 9C) of the third air cylinder driving solenoid valve 75 in the operative state. Thus, the port P2 is connected to the port P0, and the port P1 is opened to the atmosphere, so the rod 41 of the third air cylinder 40 moves forward.

When the rod 41 has moved forward until the moving end limit and the loader 7 moves in the direction of the arrow E, as shown in FIG. 1D, the sixth autoswitch 66 in the third air cylinder 40 detects the rod 41 (step S21). The controller 68 sets the other solenoid 75*b* (FIG. 9C) of the third air cylinder driving solenoid valve 75 in the inoperative state. Thus, the third air cylinder driving solenoid valve 75 is set in the neutral mode, and the rod 41 is held as it has moved forward until the moving end limit. If "NO" in step S21, the rod 41 of the third air cylinder 40 keeps extending until the sixth autoswitch 66 in the third air cylinder 40 detects the rod 41.

Then, the rod 33 of the second air cylinder 32 retracts (step S22). Namely, the controller 68 sets the other solenoid 73*b* (FIG. 9B) of the second air cylinder driving solenoid valve 73 in the operative state. Thus, the port P2 is connected to the port P0, and the port P1 is opened to the atmosphere, so the rod 33 of the second air cylinder 32 moves backward.

Figure 11E:
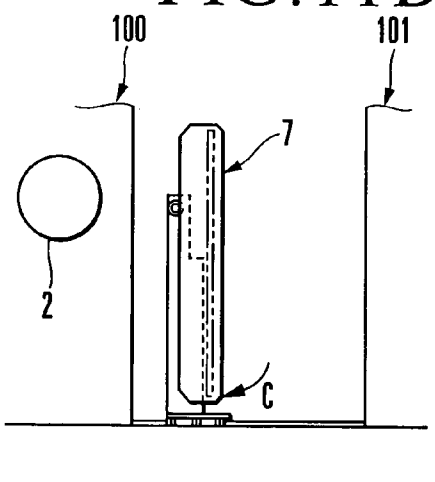
Figure 11F:
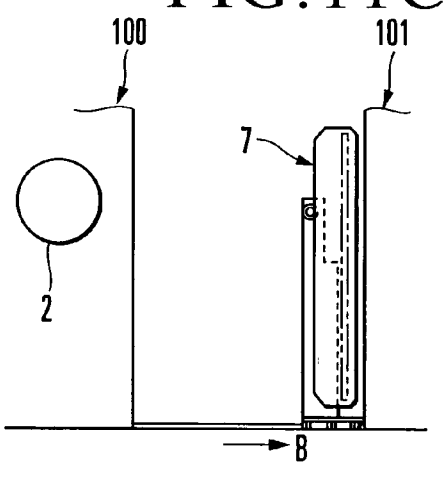

When the loader 7 pivots in the direction of the arrow C through the angle α and is set in the vertical "first swing state", as shown in FIG. 11E, the third autoswitch 53 in the second air cylinder 32 detects the rod 33 (step S22). The controller 68 sets the other solenoid 73*b* of the second air cylinder driving solenoid valve 73 in the inoperative state. Thus, the second air cylinder driving solenoid valve 73 is set in the neutral mode, and the loader 7 is held in the "first swing state", as shown in FIG. 11E. If "NO" in step S23, the rod 33 of the second air cylinder 32 keeps retracting until the third autoswitch 53 in the second air cylinder 32 detects the rod 33.

Then, the moving element 42 of the first air cylinder 18 moves in the direction of the arrow B (step S24). Namely, the controller 68 sets one solenoid 70*a* (FIG. 9A) of the first air cylinder driving solenoid valve 70 in the operative state. Thus, the port P1 is connected to the port P0, and the port P2 is opened to the atmosphere, so the moving element 42 moves in the direction of the arrow B.

When the moving element 42 has moved to the moving end limit in the direction of the arrow B, the second autoswitch 45 in the first air cylinder 18 detects the moving element 42 (step S25). The controller 68 sets one solenoid 70*a* (FIG. 9A) of the first air cylinder driving solenoid valve 70 in the inoperative state, so the first air cylinder driving solenoid valve 70 is set in the neutral mode. Thus, the loader 7 is located at the "second position" spaced apart from the printing unit 100 while being held in the "first swing state", as shown in FIG. 11F.

If "NO" in step S25, the moving element 42 of the first air cylinder 18 keeps moving in the direction of the arrow B until the second autoswitch 45 in the first air cylinder 18 detects the moving element 42. In this state, the old plate recovered by the plate recovery unit 5 is extracted in the direction of the arrow B, as described above.

As has been described above, according to the present invention, the loader is reliably positioned at the "third position" in the "third swing state" by the first and second detection units. When the plate is to be removed or supplied by the loader, the loader will not come into contact with other constituent components. Since the loader can be directly positioned at the "third position", the plate exchange time can be shortened.

Even if the plate size increases, the loader does not come into contact with other constituent components. Thus, an increase in plate size can be coped with. As the structure is simplified, the apparatus can be downsized, and the manufacturing cost can be reduced.

What is claimed is:

1. A plate handling apparatus comprising:

a loader which is supported to be movable substantially parallel to a paper convey direction and swingable in directions to come close to and be spaced apart from an outer surface of a plate cylinder to perform plate removal/supply;

first driving means for moving said loader among a first position close to said plate cylinder, a second position spaced apart from the first position in the paper convey direction, and a third position which is between the first position and the second position;

second driving means for swinging said loader among a first swing state where said loader is substantially perpendicular to the paper convey direction, a second swing state where said loader is inclined such that a distal end thereof faces said plate cylinder, and a third swing state which is between the first swing state and the second swing state;

first detection means for detecting a position of said loader in the paper convey direction; and second detection means for detecting a swing state of said loader; and control means for controlling said first driving means and said second driving means, wherein said control means controls said second driving means so as to cause said loader positioned at said third position to swing into said third swing state, then controls said first driving means so as to cause said loader to move from said third position to said first position, and thereafter controls said second driving means so as to cause said loader swing from said third swing state into said second swing state to subsequently accomplish the plate removal/supply operation.

2. An apparatus according to claim 1, wherein when said loader is at the first position in the second swing state, said distal end of said loader comes close to said outer surface of said plate cylinder to supply/remove the plate to/from said plate cylinder.

3. An apparatus according to claim 1, further comprising:

a support member which supports said loader and a swing/slide mechanism of said loader and is moved substantially parallel to the paper convey direction by said first driving means substantially; and third driving means, connected to said swing/slide mechanism of said loader, for moving said loader in a longitudinal direction.

4. An apparatus according to claim 1, wherein each of said first driving means and said second driving means comprises a hydropneumatic cylinder.

5. An apparatus according to claim 1, wherein said first detection means detects that said loader is located at the third position, and that said loader is located between the first position and the third position and between the second position and the third position.

6. An apparatus according to claim 5, wherein said first detection means detects that the loader is located at the first position and the second position.

7. An apparatus according to claim 1, wherein said second detection means detects that said loader is in the third swing state, and that said loader is between the first swing state and the third swing state and between the second swing state and the third swing state.

8. An apparatus according to claim 7, wherein said second detection means detects that the loader is in the first swing state and the second swing state.

9. An apparatus according to claim 1, wherein said first detection means comprises a first detection target portion and second detection target portion which are attached in relation to said loader, and a first stationary switch and second stationary switch which are arranged to be spaced apart from each other in a moving direction of said loader to correspond to said first detection target portion and said second detection target portion.

10. An apparatus according to claim 9, wherein when said loader is located in a range of the first position to the third position, said first stationary switch detects said first detection target portion, and when said loader is located at the third position, said second stationary switch detects said second detection target portion.

11. An apparatus according to claim 10, wherein when said loader is located in a range of the second position to the third position, said first stationary switch does not detect said first detection target portion, and said second stationary switch does not detect said second detection target portion either.

12. An apparatus according to claim 10, further comprising:

a first state detection switch which detects a state of said first driving means when said loader is located at the first position; and a second state detection switch which detects the state of said first driving means when said loader is located at the second position.

13. An apparatus according to claim 9, wherein said first detection target portion comprises a first detection target element fixed to a base, said second detection target portion comprises a second detection target element fixed on said first detection target element and having a length "W ", said first detection target element projecting more upstream in the paper convey direction than said second detection target element, said first stationary switch comprises a proximity switch which detects said first detection target element, and said second stationary switch comprises a proximity switch which detects said second detection target element, said second stationary switch being arranged at a position higher than said first stationary switch by "H " and spaced apart from said first stationary switch upstream in the paper convey direction by a length "L ".

14. An apparatus according to claim 1, wherein said second detection means comprises a first detection target portion and second detection target portion which are attached in relation to said loader, and a first stationary switch and second stationary switch which detect said first detection target portion and said second detection target portion correspondingly and are arranged to be spaced apart from each other in a moving direction of said loader.

15. An apparatus according to claim 14, wherein when said loader is in a range of the first swing state to the third swing state, said first stationary switch detects said first detection target portion, and when said loader is in the third swing state, said second stationary switch detects said second detection target portion.

16. An apparatus according to claim 15, wherein when said loader is in a range of the second swing state to the third swing state, said first stationary switch does not detect said first detection target portion, and said second stationary switch does not detect said second detection target portion either.

17. An apparatus according to claim 15, further comprising:

a first state detection switch which detects a state of said second driving means when said loader is in the first swing state; and a second state detection switch which detects the state of said second driving means when said loader is in the second swing state.

18. An apparatus according to claim 14, wherein said first detection target portion comprises an arcuate member fixed to an intermediate member rotatably supported by a pivot shaft which is moved together with said loader by said first driving means, said second detection target portion comprises a projecting member which projects from said arcuate member toward said pivot shaft, said first stationary switch comprises a proximity switch which is fixed to a support member and detects said arcuate member, and said second stationary switch comprises a proximity switch which is fixed to said support member and to a frame to be spaced apart from said first stationary switch by a gap "S " in a swing direction of said intermediate member, and detects said second detection target member.

19. An apparatus according to claim 1, wherein said control means further controls a third driving means to drive said loader so as to move downward in a longitudinal direction, controls said first driving means to drive said loader so as to move to the third position, controls said third driving means to drive said loader so as to move upward in the longitudinal direction, and controls said second driving means to drive said loader so as to swing into the first swing state.

20. An apparatus according to claim 19, wherein when said loader is not located at the third position in an initial state, said control means drives said first driving means to drive said loader so as to move to the third position.

21. An apparatus according to claim 1, wherein said first detection detects said loader with reference to a predetermined range "W" in the paper convey direction as the third position.

22. An apparatus according to claim 1, wherein the paper comprises a web, and the paper convey direction comprises a web convey direction.

* * * * *